United States Patent [19]

Smith

[11] Patent Number: 4,692,082

[45] Date of Patent: Sep. 8, 1987

[54] ADJUSTABLE DUAL-WHEEL CADDY

[76] Inventor: Otis O. Smith, Box 352, Frankston, Tex. 75763

[21] Appl. No.: 809,780

[22] Filed: Dec. 17, 1985

[51] Int. Cl.[4] ..... B66F 9/12

[52] U.S. Cl. ..... 414/429; 74/89.14

[58] Field of Search ..... 414/429, 426; 74/89.14, 74/89.17

[56] References Cited

U.S. PATENT DOCUMENTS

| | | | |
|---|---|---|---|
| 1,361,889 | 12/1920 | Miller et al. | 414/429 X |
| 2,380,415 | 7/1945 | Carruthers | 414/429 |
| 2,392,409 | 1/1946 | Ray | 414/429 |
| 2,538,473 | 1/1951 | Russell et al. | 414/426 |
| 2,554,365 | 5/1951 | Johnston, Jr. et al. | 414/592 X |
| 2,812,086 | 11/1957 | Kuenzi | 414/429 |
| 3,937,343 | 2/1976 | Spulak | 414/428 |

FOREIGN PATENT DOCUMENTS

| | | | |
|---|---|---|---|
| 568884 | 11/1957 | Italy | 74/89.14 |

*Primary Examiner*—Robert J. Spar
*Assistant Examiner*—Stuart J. Millman
*Attorney, Agent, or Firm*—Lowe, Price, LeBlanc Becker & Shur

[57] ABSTRACT

An adjustable dual-wheel caddy for supporting wheel assemblies when they are removed from vehicles is described. The caddy includes a U-shaped support having a single movable leg and rollers along the lower surfaces of both legs. A crank handle is provided to manually change the bight of the "U" only in response to rotation thereof. An internal rack is provided along at least a portion of the bight of said "U". A spur gear is rotatably mounted on the movable leg in mesh with the rack and a worm gear is mounted on the crank handle to drive the spur gear in response to manual rotation.

1 Claim, 7 Drawing Figures

ADJUSTABLE DUAL-WHEEL CADDY

This invention relates to a device for mounting and dismounting tire assemblies on trucks and the like. The device is intended to facilitate the mounting or dismounting of even large dual-wheel assemblies including the tires, wheels, and brake drum assemblies as a single unit whereby an individual can mount or dismount such assemblies without undue physical strain.

The prior art contains several dolly-like devices for moving wheels. Certain of such devices also are adjustable laterally to support wheels of different diameters. See, for example, U.S. Pat. Nos. 3,937,343; 2,554,365; and 2,538,473. In those patents, lateral adjustment of opposed supporting members is either achieved by a lever arrangement or a threaded shaft. In each instance, however, opposed support members must simultaneously be moved toward and away from each other. Simultaneous movement of both opposed support members then requires a complicated mechanism. Provisions are also made for raising and lowering the tire through separate mechanisms. Therefore, these prior art devices are relatively complicated, inherently expensive to manufacture, and subject to extra maintenance requirements.

It is desired then to develop a caddy which is adjustable for different diameter wheels which is dependable, easy to operate, and which uses a mechanism sufficiently uncomplicated to avoid undue maintenance.

It has been discovered that such a relatively uncomplicated and dependable device can be developed utilizing a U-shaped support in which the bight of the "U" is adjusted by moving only a single leg member. Movement is facilitated by the use of a rack and worm gear assembly similar to a heavy-duty trailer tongue jack. Opposed rollers are also provided within the "U" so that the tire assembly can be adjusted vertically, slightly, as the bight of the "U" is altered.

Accordingly, it is an object of this invention to provide a caddy which can be adjusted to support any size tires for trucks and the like.

It is another object of this invention to provide an adjustable caddy mounted on wheels which easily and dependably can support such wheels as they are mounted or dismounted from a truck or the like by a single operator.

It is another object of this invention to provide a dual-wheel caddy which has an adjustable support mechanism, which is U-shaped, and mounted on wheels so that adjustment is provided by movement of a single leg member toward or away from a fixed leg member on the U-shaped housing.

It is still another object of this invention to provide an adjustment mechanism for a U-shaped wheel caddy wherein the bight of the "U" can be changed by rotating a worm gear in mesh with a spur, which in turn is enmeshed with a rack gear so that a separate locking mechanism will not be necessary to adjust the bight of the "U" even when a wheel assembly is supported thereon.

These and other objects will become readily apparent with reference to the drawings and following description wherein.

Figure 1:
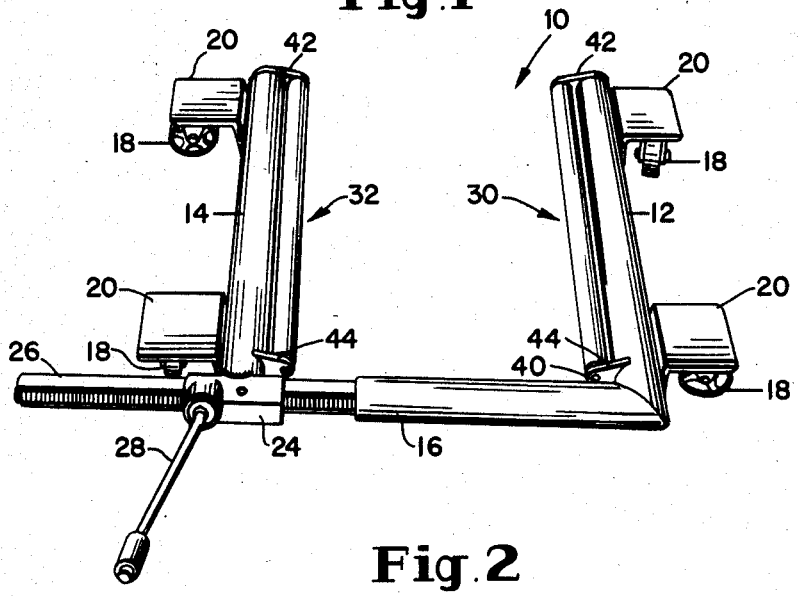
FIG. 1 is a perspective view of the device of this invention.
Figure 2:
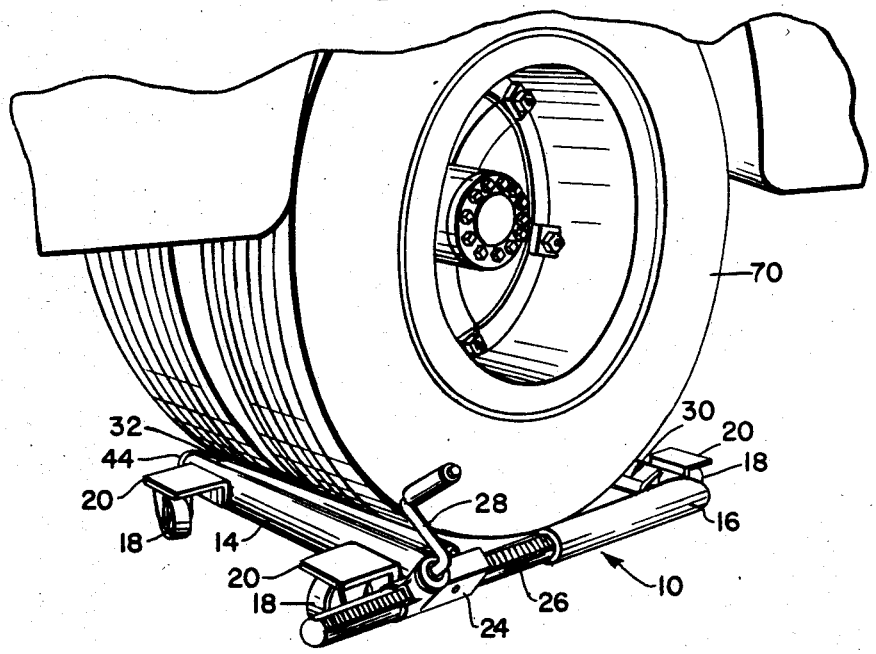
FIG. 2 is a fragmentary perspective view of the device of this invention supporting a dual truck wheel assembly.
Figure 3:
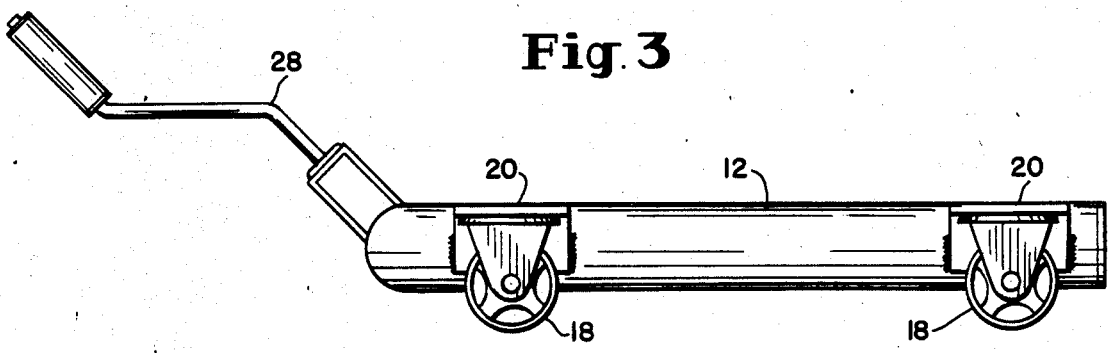
FIG. 3 is a side view of the device of this invention.

With attention to the drawings and to FIGS. 1–4 in particular, the device 10 of this invention is a generally U-shaped support consisting of upright legs 12 and 14 and a laterally adjustable base or bight 16. Heavy-duty wheels 18 are mounted thereon by mounting brackets 20. As shown in FIG. 3, brackets 20 are welded to legs 12 and 14 and are generally L-shaped. Wheel assemblies 18 are then welded to the upper surface of brackets 20 and are permitted to swivel.

Members 12, 14, and 16 may be, for example, $2\frac{1}{8}$ inch diameter schedule 40 steel pipe.

Figure 4:
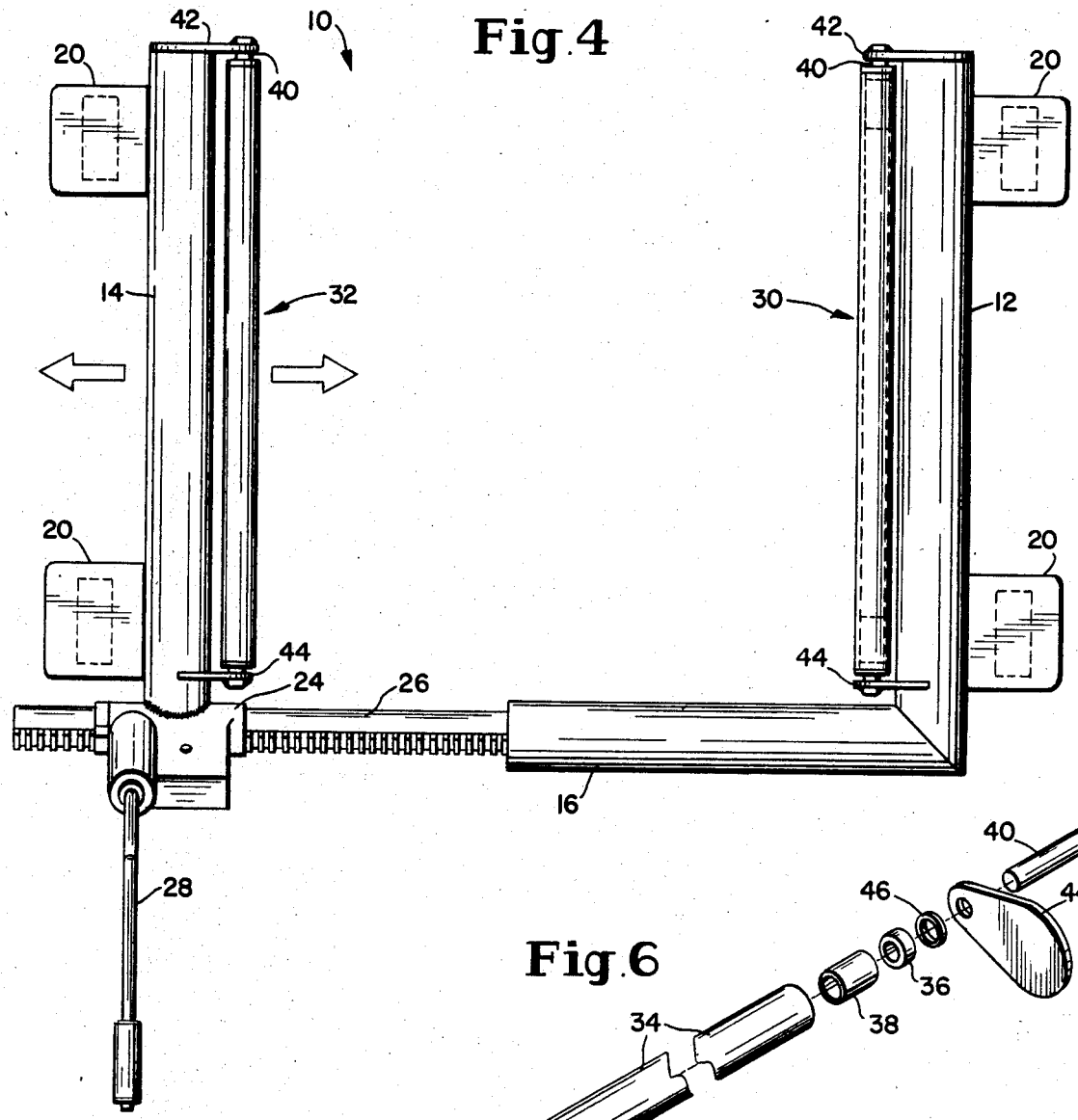
FIG. 4 is a top view of the device of this invention.

As shown in FIG. 4, leg 14 is mounted on adjustment assembly housing 24 which in turn receives a rack member 26. Rack member 26 is rigidly received within base member 16. A crank handle 28 is provided whereby rotation of handle 28 will cause the bight of device 10 to change as member 14 is moved in the directions shown in FIG. 4. As noted above, the adjustment assembly is similar to a standard heavy-duty trailer tongue jack such as that manufactured by Bull Dog Manufacturing Company.

Figure 6:
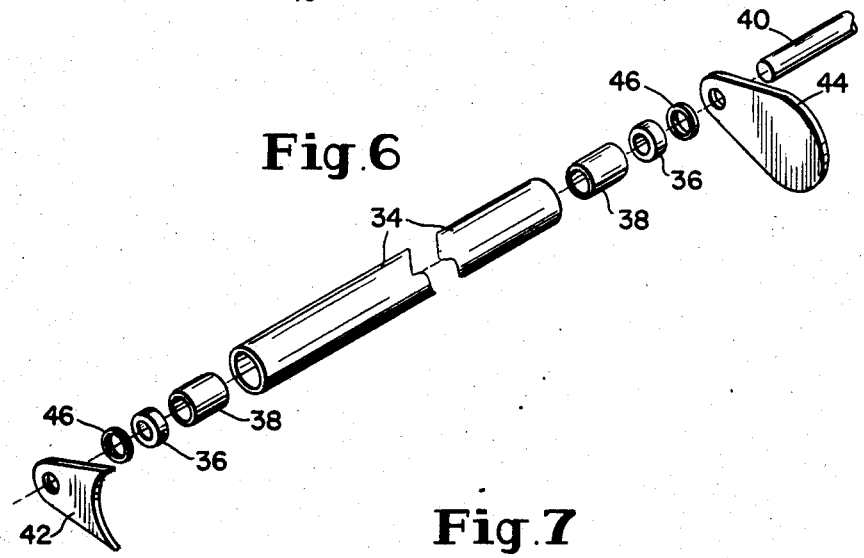
FIG. 6 is an exploded view of one of the rollers of this invention.
Figure 7:
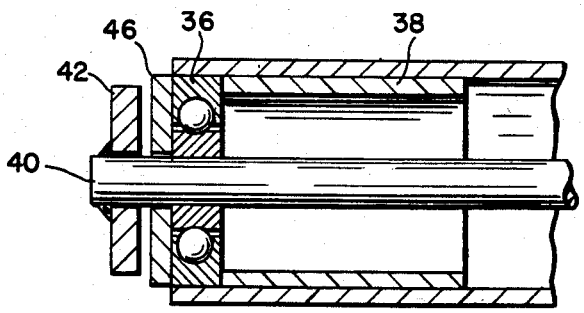
FIG. 7 is a fragmentary view in partial section of the end portion of one of the rollers of the device of this invention.

Legs 12 and 14 also mount internal rollers 30 and 32. With attention to FIGS. 6 and 7, each roller 30 and 32 consists of an external housing 34 which may be, for example, a $1\frac{1}{2}$ inch diameter schedule 40 steel pipe. At either end, bearings 36 are provided and bearings 36 are intended to be received within the end of the pipe member along with a spacer 38 as shown in FIG. 7. Bearings 36 may be standard automotive seal bearings, such as No. 204, and the spacer may be a $2\frac{1}{2}$ inch long, $1\frac{1}{4}$ inch diameter schedule 40 steel pipe spacer. A central shaft 40 is received through each roller 30 and 32. Mounting brackets 42 and 44 are welded to either end of the legs 12 and 14 as shown in FIG. 4. Shafts 40 extend through brackets 42 and 44 and are secured therein by welds as shown in FIG. 7. Spacer washers 46 are also provided to separate bearings 36 from the respective mounting brackets 42 or 44.

Figure 5:
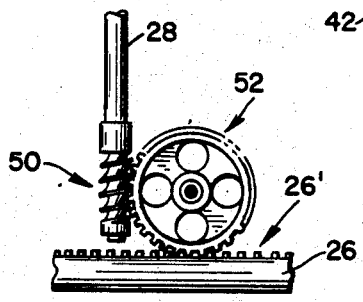
FIG. 5 is a fragmentary view of the adjustment assembly of the device of this invention having its housing removed.

With attention to FIG. 5, in order to achieve lateral adjustment of leg 14, crank 28 mounts a worm gear 50 which in turn meshes with a spur 52. Spur 52 then meshes with the teeth 26' on rack 26. As is well known, the incline plane of the worm gear 50 will lock spur 52 from movement in rack 26 based upon a force directed against leg 14 in either direction shown by the arrows in FIG. 4. However, rotation of the crank will move the assembly quite readily.

With reference to FIG. 2, in order to use the device of this invention 10, the truck axle (not shown) is jacked until the wheels 70 are about 2 inches off the ground. The device 10 is then moved under the wheels and crank 28 turned until rollers 30 and 32 support the truck tire. The bolts retaining the wheel assembly 70 on the axle can then be removed and the entire assembly moved as a unit on the caddy 10 manually by rolling the assembly on wheels 18.

In order to mount such an assembly, it may be necessary to vertically adjust the height of the tire assembly 70. Minor vertical adjustment can be achieved with crank 28 to increase or decrease the bight of the U-shaped assembly 10 with the tire assembly supported thereon. If the bight is, for example, decreased by cranking hand crank 28, roller 32 and leg 14 will move toward roller 30 and leg 12. As this action takes place, the tire assembly supported by rollers 30 and 32 will be lifted vertically. The assembly may be lowered by reversing the action of crank 28. It will be obvious to those skilled in the art, however, that only minor vertical adjustment can be achieved in this fashion.

In summary, an effective adjustable caddy assembly has been developed wherein the bight of a U-shaped support assembly is adjusted by movement of a single leg thereof. Furthermore, by utilizing a worm gear, spur gear and offset rack, the need for a ratchet mechanism or locking mechanism is avoided. Accordingly, the device of this invention is readily adjustable and provides a relatively maintenance-free caddy for tire assemblies.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An adjustable wheel caddy comprising:

a normally horizontally disposed U-shaped support having opposed legs and a connecting bight therebetween, said bright having an integral rack on an upper surface thereof, one of said legs being integral with said bight and one of said legs being movable, said support being adapted to receive a wheel on the upper portion of said legs;

opposed roller members mounted internally to said support, said members extending along the internal surfaces of said opposed legs and disposed so that when a wheel is resting on said caddy it will be supported on said rollers;

wheel means affixed to the lower surface of said U-shaped support for permitting horizontal movement of said caddy; and adjustment means connecting said movable leg and the bight for displacing said leg toward or away from the leg, said adjustment means including a manual actuator means for permitting displacement of said movable leg only in response to said actuator means so that when a wheel is supported thereon the weight thereof will not displace the leg, said adjustment means comprising a sleeve and upwardly extending housing mounted on an end of said movable leg adjacent said bight, said sleeve slidably receiving said rack, a spur gear rotatably mounted within said housing in mesh with said rack, a worm gear rotatably mounted within said housing in mesh with said spur gear and a crank handle integral with said spur extending upwardly and outwardly from said housing and being rotatable relative thereto to drive said spur which in turn translates rotation to linear movement of said sleeve, housing and movable leg along said rack whereby said bight will be increased or decreased in length only in response to rotation of said crank handle.

* * * * *